US006526617B1

(12) United States Patent
Dingert

(10) Patent No.: US 6,526,617 B1
(45) Date of Patent: Mar. 4, 2003

(54) WET MOP WITH A ROTATABLE HANDLE

(75) Inventor: Uwe Dingert, Abtsteinach (DE)

(73) Assignee: Firma Carl Freudenberg, Weinheim (DE)

( * ) Notice: Subject to any disclaimer, the term of this patent is extended or adjusted under 35 U.S.C. 154(b) by 0 days.

(21) Appl. No.: 09/546,571

(22) Filed: Apr. 10, 2000

(30) Foreign Application Priority Data

Apr. 13, 1999 (DE) ..... 199 16 626

(51) Int. Cl.[7] ..... A47L 13/142
(52) U.S. Cl. ..... 15/120.2; 15/120.1
(58) Field of Search ..... 15/120.1, 120.2

(56) References Cited

U.S. PATENT DOCUMENTS 1,255,804 A * 2/1918 Shipherd
1,710,190 A 4/1929 Regan
2,042,892 A * 6/1936 Granger
2,230,101 A 1/1941 Bakemeier
2,365,437 A * 12/1944 Schaefer
5,722,105 A * 3/1998 Thomasson
5,890,253 A * 4/1999 Morad
5,907,883 A * 6/1999 Thomasson

* cited by examiner

*Primary Examiner*—Randall E. Chin
(74) *Attorney, Agent, or Firm*—Kenyon & Kenyon

(57) ABSTRACT

A wet mop with a handle and a mop head made of absorbent strands or the like. The mop head is releasably attached to the end of the handle at its bottom end, and to a handpiece that can be moved relative to the handle at its top end. The handle is provided with a helical groove in a top first partial region of the region covered by the mop head in its extended, stretched position. A guide element of the handpiece is guided in this groove. The handle has a lower second partial region below the first region. The second region releases the guide element and therefore also the handpiece.

13 Claims, 3 Drawing Sheets

WET MOP WITH A ROTATABLE HANDLE

FIELD OF THE INVENTION

The present invention relates generally to mops, and more particularly, to a wet mop with a handle and a mop head made of absorbent strands or the like, which mop head is releasably attached to the end of the handle at its bottom end, and to a handpiece that can be moved relative to the handle at its top end.

BACKGROUND OF THE INVENTION

For cleaning floors, stairs, and the like, increasing use is being made of wet mops. Wet mops are a significantly easier way of working. More and more frequently, wet mops with mop heads that can be wrung out by mechanical rotation relative to the handle are being used.

U.S. Pat. No. 1,710,190 shows a wet mop that allows mechanical wringing of the mop head. The handle of the wet mop is surrounded by a pipe-like sleeve. The sleeve has a handpiece that is attached to the top end of the mop head. The bottom end of the mop head is attached at the end of the handle. The top half of the handle is provided with a helical groove and has another handpiece. To wring the mop head out, the sleeve is held tight with one hand, while the handpiece on the handle is moved toward the sleeve with the other hand. The helical groove causes the handle to rotate. This wet mop has the disadvantage that the mop head reaches the floor only with its bottom strands, and that the wringing process takes place only by rotation of the mop head. The distance between the mop head ends is always the same, so that if the strands become longer, e.g. when they are wet, it is no longer possible to wring them out completely. This is particularly true since the handpiece on the handle can impart only a predetermined number of rotations to the handle before the handpiece hits the sleeve.

U.S. Pat. No. 2,230,101 describes a wet mop head that allows the strands to be folded in half. For cleaning use, the attachment parts for the ends of the strands lie directly next to one another, and the strands are doubled up in loops. The handle has a handpiece that can be moved along the handle. The top end of the mop head is attached to the handpiece. The handpiece has a ball that is guided in a groove in the handle. The groove has a first segment that runs in the longitudinal direction of the handle, followed by a helical segment. A rotatable knob is affixed to the top end of the handle. Thus, the handle can rotate if the handpiece is pulled upward and engages in the helical groove. For the wringing process, the handpiece, with the top end of the mop head, is first pulled upward, while the handle remains in the rest position. Then the ball of the handpiece gets into the helical part of the handle, and the handle begins to rotate. When this happens, the second hand of the person using the mop must hold the rotating knob at the top end of the handle. In order to carry out the wringing process, the handpiece and the knob, which are quite far apart, must both be held by the person using the mop, and the handpiece must be pulled upward. This action cannot be performed without difficulty.

SUMMARY OF THE INVENTION

An object of the present invention is to create a wet mop with an easy wringing process. Another object of the invention is to create a mop where the water is wrung out as completely as possible.

These objects are achieved with a wet mop that has a handle with a helical groove. The helical groove is in a top first partial region of the region covered by the mop head in its extended, stretched position. A guide element of a handpiece is guided in this groove. The handle has a lower second partial region below the first region. The lower region releases the guide element and therefore also the handpiece. The handle is fixed in place and the mop head is stretched, subsequently twisted, and finally compressed by the movement of the handpiece along the handle. The length of the path that the handpiece must follow is at most the length of the stretched mop head. Thus, rotation of the handle is avoided, and the hand holding the handle can hold the handle approximately at the height of the handpiece when it is pulled up.

The handpiece is preferably made in two parts. The first part is a first inner sleeve that is equipped with the guide element and an attachment device for the top end of the mop head. The second part is an outer holder mantle that surrounds the sleeve so as to rotate around it. The handpiece performs two functions. First, the sleeve holds the top end of the mop head. Second, the sleeve rotates when the handle is moved in the direction of the end of the handle. The guide element causes the rotation. The sleeve with the attachment device for the mop head can rotate relative to the holder mantle.

A ball held captive in the wall of the sleeve, that can be radially shifted, can be used as the guide element. In order to prevent uneven stress on the sleeve, the helical groove can be formed as a double helix and two movable balls can be arranged in the sleeve, opposite one another.

In a preferred embodiment, the holder mantle can be axially shifted relative to the sleeve only within certain limits. The axial shifting locks or releases the guide element. This ensures that the rotation of the top attachment device for the mop head can be controlled at will. For example, if the holder mantle is moved upward relative to the sleeve, the guide element is released, while if the holder mantle is shifted downward, the guide element is locked. If the handpiece is moved from its bottom position upward, the holder mantle first moves along a limited path and thereby releases the guide element. The holder mantle then moves the sleeve and the handpiece slides over the partial region with the helical groove without the guide element being guided in the groove so that the sleeve and therefore the attachment device for the mop head do not rotate. All that happens is that the strands of the mop head are pulled lengthwise and stretched in the axial direction. A spring-assisted stopping element is provided on the handle, holding the sleeve in its top end position. This top end position of the sleeve can be limited, by a stop. If the holder mantle is moved downward from its top position, the sleeve at first remains in its top end position, held by the stopping element.

If the holder mantle reaches its bottom end position on the handpiece, and thereby has locked the guide element in place, pressing on the handpiece again causes the sleeve to be stopped, and causes the sleeve to rotate via the guide element guided in the helical groove. The rotation of the sleeve and therefore also of the one end of the mop head is continued until the guide element leaves the helical groove again, at the bottom. The pitch of the helical groove can be structured in different ways to achieve the desired wringing effect.

The partial region provided with the helical groove has a larger diameter than the handle. Therefore, as soon as the guide element has left the partial region with the helical groove, the sleeve can rotate freely, although the guide element is still locked. This allows compression of the mop head without any required additional rotation. This provides a particularly good wringing effect.

Preferably, a free region with a smaller diameter is provided above the helical groove, allowing rotation of the sleeve at any time, and also permitting the sleeve to be locked in any rotational position. The free region can be an annular groove that holds the guide elements during the locking process. The top end of the helical groove has funnel-shaped openings to direct the guide elements into the helical groove.

Preferably, the attachment device for the top end of the mop head has a greater radius than the connection location for the mop head on the end of the handle. In the position of use, the strands then lie on top of one another, in advantageous manner.

The mop head according to the invention is very easy to handle and allows reliable wringing of the mop head.

Proceeding from the position of use of the wet mop, its function will be explained below. In the position of use, the handpiece is in its bottom-most position. The attachment locations for the ends of the mop head are adjacent to one another and the mop head forms loops that hang freely downward. To wring the mop, the handpiece is pulled up. Upon being pulled up, the holder mantle shifts relative to the sleeve surrounded by the holder mantle and the guide elements are released. The guide elements can therefore move radially outward in the sleeve wall. The guide elements, however, are prevented from falling out by their holder devices in the sleeve. If the handpiece is moved further upward, the sleeve moves with the handpiece. The top end of the mop head, which is held on the sleeve by the attachment device, moves with the sleeve. The guide elements then lie within the sleeve wall. The handpiece, along with the mantle and the sleeve, slides axially over the second partial region of the handle, and then over the first partial region that is provided with the helical groove, and finally they reach their top end position. The sleeve is then axially stopped on the handle, but can be rotated freely in both directions of rotation. The strands of the mop head are stretched and aligned approximately parallel to the direction of the handle. If the handpiece is moved downward, first the holder mantle follows the hand movement, and the guide elements are locked in the sleeve by being pressed radially inward by the inside wall of the holder mantle. Upon further downward movement, the sleeve is released from its stopped position, the sleeve is taken along by the handpiece, and the guide elements are introduced into the helical groove via the funnel-shaped groove openings. The sleeve and therefore also the attachment device and the top end of the mop head are rotated by the guide elements that slide in the grooves. The rotation follows the predetermined helical groove, which is designed for two to three rotations. This number of rotations is generally sufficient to cause the strands to be wrapped tightly around the wet mop handle. The amount of possible rotation is facilitated by the fact that the holder device for the top end of the mop head moves toward the end of the handle at the same time as the rotation, so that the distance between the two attachment devices for the ends of the mop head constantly decreases during the rotation. The helical groove is designed in such a way, in terms of the number of its windings, its length, and its pitch angle, which can be different over the length of the helix, that the wringing process is essentially complete at the end of the helical groove.

The handpiece can be pushed further downward, into the lower, second partial region of the mop handle. The mop head is then no longer being rotated. However, it is subject to additional compression, which allows any remaining water to be additionally pressed out. The length of the second partial region is selected so that it approximately corresponds to the length of the handpiece. The diameter of this partial region is equal to or less than the diameter at the bottom of the groove. Although, the guide elements are still locked, the sleeve can freely rotate on the mop handle after the guide elements leave the helical groove. After the handpiece is let go, the mop head loops attempt to return to their original position, simply due to their weight alone, and the wet mop can be used for cleaning again.

The overall process, including pulling the mop head strands tight, rotating the strands for the wringing process, and pressing out the strands, takes place by a single back and forth movement of the handpiece.

This embodiment provides an advantageous additional effect. After completion of cleaning activity, the mop head strands are pulled up and tightened by pulling up the handpiece and stopping it in its top position. If the wet mop is put away in this position, the mop head strands are accessible to the air from all sides and can dry well.

DETAILED DESCRIPTION

Figure 1:
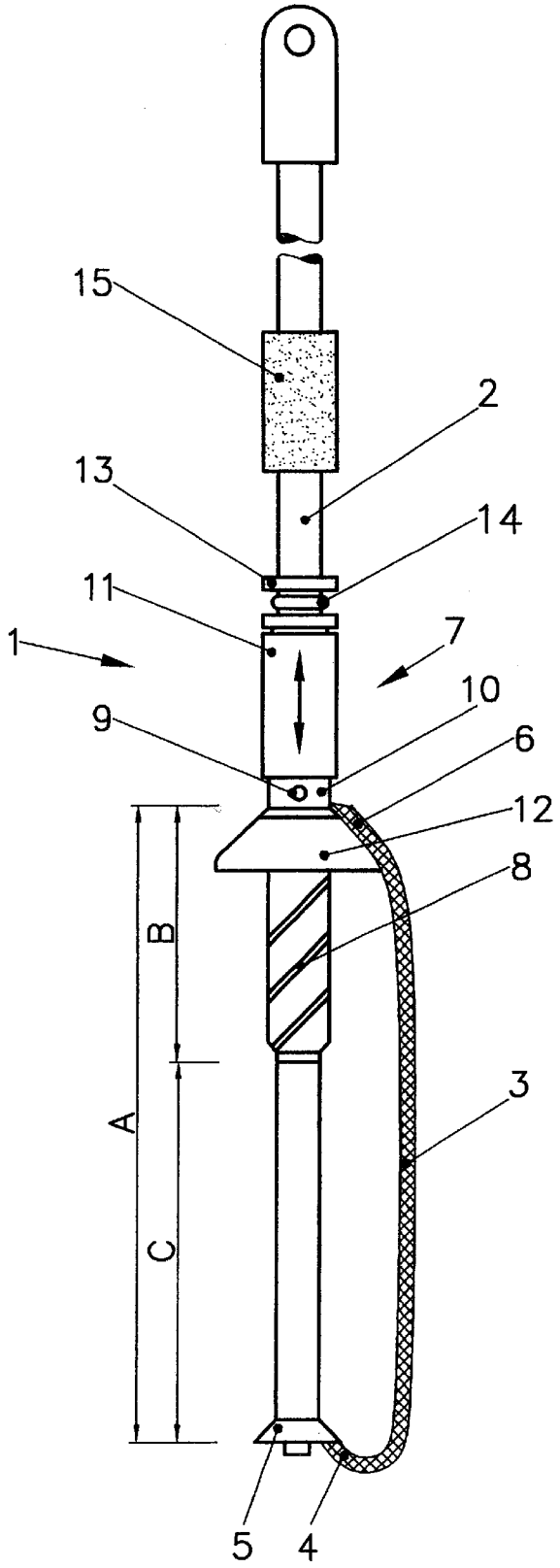
FIG. 1 shows a wet mop constructed in accordance with the present invention in a side view.

Wet mop 1 shown in FIG. 1 has a handle 2 and a mop head 3. The mop head is made up of absorbent strands. The mop head 3 is attached to a handle end 5 at its bottom end 4. The top end 6 of the mop head 3 is attached to a movable handpiece 7. The attachments of the mop head 3 allow replacement of the mop head 3. When the mop head 3 is used up, it can consequently be replaced. Attachment devices used for this purpose are known and are therefore not shown in the drawing. Furthermore, the mop head 3 in FIG. 1 is only indicated in general terms on the right side of the handle 2. The part that completely surrounds the handle 2 is left out, in order not to cover the structure of the elements of the invention. The region A of the handle 2, which is covered by mop head 3 in the extended position of mop head 3, as shown, is divided into a top first partial region B, and a bottom second partial region C. Top partial region B is provided with helical groove 8. In partial region C, the handle 2 has the same diameter as the handle 2 above the handpiece 7 when the latter is pulled up. Guide elements 9 are affixed to the handpiece 7. When the handpiece 7 is pushed downward, the guide elements are guided in helical groove 8 and cause mop head 3 to be rotated. The rotation wrings out the mop head. The rotation takes place until the guide elements 9 exit from the helical groove 8 in partial region C. Further movement of the handpiece 7 downward causes further compression of the mop head 3, which rests against the handle 2 as a result of the prior rotatory movements.

The handpiece 7 is formed by an inner sleeve 10 and by holder mantle 11. The attachment device 12 for the top end 6 of the mop head 3 and the guide elements are affixed to the inner sleeve. The inside diameter of the sleeve 10 is adapted to the outside diameter of the helical groove 8 so that the sleeve 10 can slide over the helical groove 8. The holder mantle 11 is affixed to the top of the sleeve 10. The holder mantle 11 can rotate and is seated on sleeve 10 so as to be shifted in the longitudinal direction.

Two balls that lie opposite each other are inserted into the wall of the sleeve 10 to form guide elements 9. The balls 9 are held captive in the wall of the sleeve 10, but can move, within limits, in the radial direction. The helical groove 8 is structured as a double helix, so that each ball 9 has its own groove track.

The sleeve 10 permits limited axial displacement of the holder mantle 11 so that the guide element 9 is released, as shown in the figure, or is locked if the holder mantle 11 presses the guide element 9 inward with its inside surface, thereby locking it in place.

The movement of the handpiece 7 upward is limited by an end stop 13. The end stop 13 is provided with a stopping element 14. The stopping element holds the sleeve 10 and therefore the handpiece 7 in the top end position.

An easy-grip cover 15 is affixed to the handle 2 in order to provide a good hold for the second hand of the wet mop user.

Figure 2:
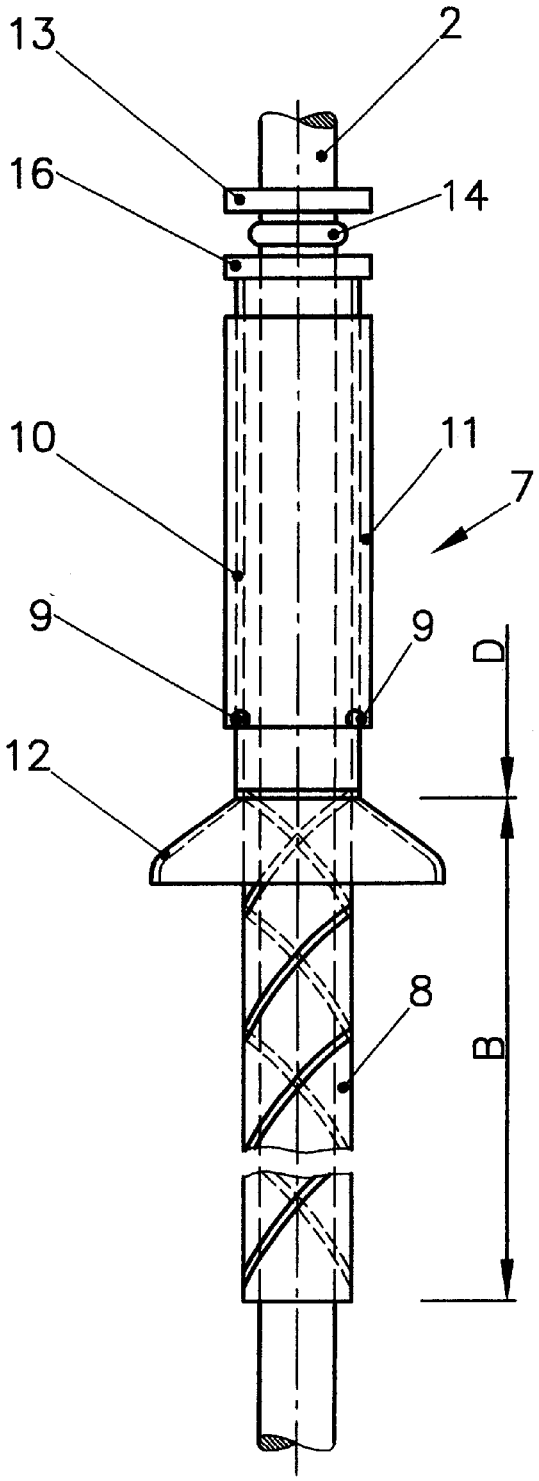
FIG. 2 shows the structure of the handpiece of FIG. 1 in a side view.

FIG. 2 shows the handpiece 7. The handle 2 has a uniform diameter throughout. The helical groove 8 is a double helix and is formed in the handle 2. Other embodiments are also possible, for example, the helical groove 8 can be made in one piece with the handle 2. The handpiece 7 is made up of the sleeve 10, which has the attachment device 12 for the top end of the mop head 3 at its bottom end. Furthermore, the sleeve 10 bears the balls 9, which are the guide elements. The balls slide in the grooves of the helical groove 8 if the handpiece 7 is pushed downward. Each ball 9 slides in its own helical groove. The holder mantle 11 is attached to the sleeve 10 so as to rotate and move axially. In the figure, the holder mantle 11 is shown pushed downward, and presses the balls 9 inward with its inside surface.

The partial region B ends at the top end of the helical groove 8. Above the helical groove 8, there is a free region D. The free region D permits the balls 9 to move radially inward in the sleeve 10, locking them in place. The free region D is formed by the handle 2 in the illustrated embodiment.

A flange 16 is affixed to the top end of the sleeve 10. The flange has an annular groove on its inside. The stopping element 14 snaps into the annular groove, holding the sleeve 10 in its top position. In addition, an end stop 13 is attached to the handle 2. Moving the holder mantle 11 upward causes the balls 9 to be released. The holder mantle 11 is stopped against the flange 16, which is finally pushed over the stopping element 14 all the way to the end stop 13.

Figure 3:
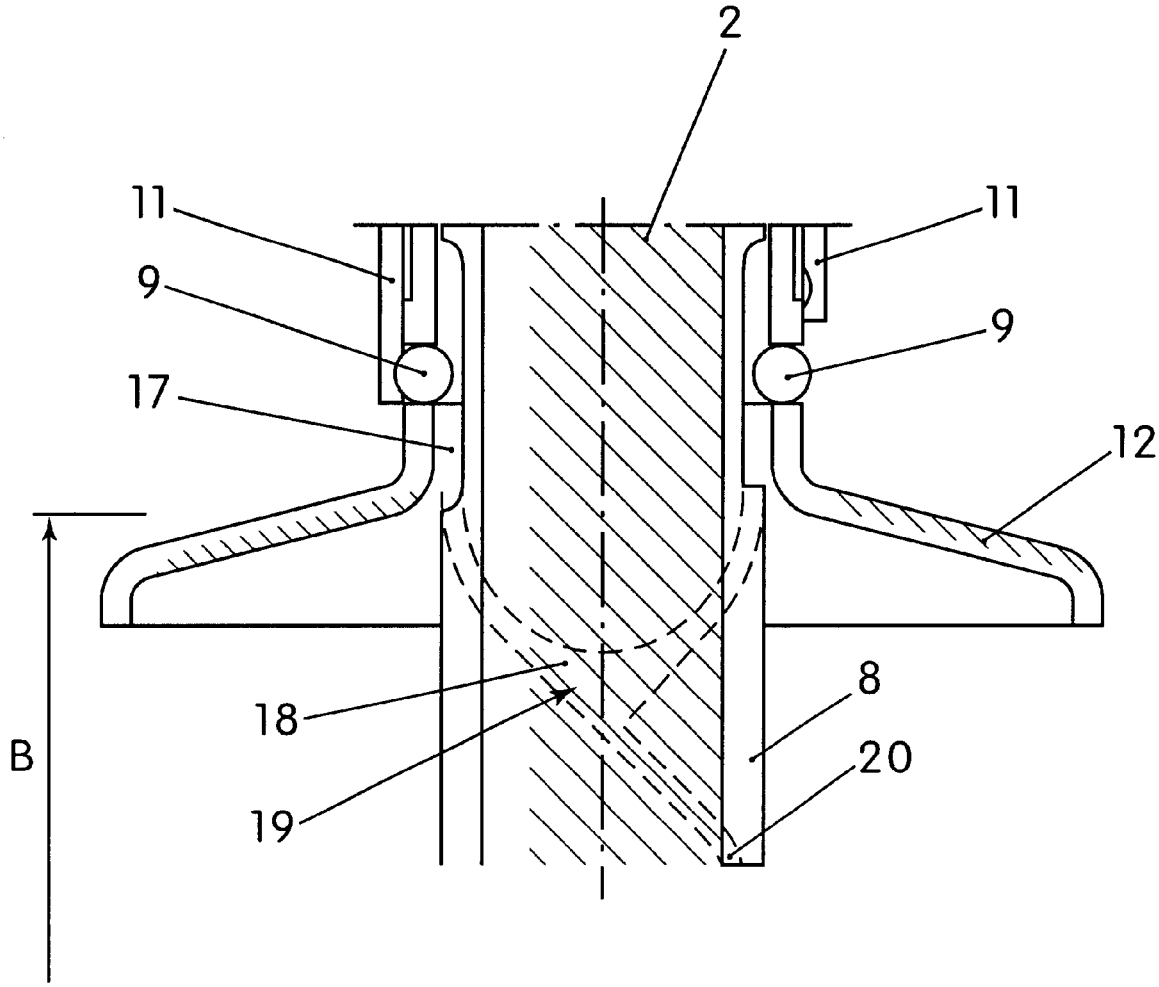
FIG. 3 shows a magnified view of the handpiece of FIG. 1 with the guide elements.

FIG. 3 shows the region of the sleeve 10 that is provided with balls 9, on a larger scale. On the left side of the figure, the ball 9 is locked in place, while on the right side, it is released. The holder mantle 11 is pushed over the ball 9 on the left side of the figure, while the holder mantle 11 is retracted on the right side, releasing the ball 9. In this embodiment, the handle 2 is surrounded by the helical groove 8 in the partial region B, as already discussed in connection with FIGS. 1 and 2. However, the helical groove 8 is continued upward on the handle 2, specifically with a reduced diameter that is equal to or less than the diameter at the bottom of the groove. Here an annular groove 17 can be formed, for example, permitting the balls 9 to be moved inward in every position of the sleeve 10. At the top end 18 of the helical groove 8, funnel-shaped openings 19 are provided, allowing easy introduction of locked balls 9 into the groove 20.

What is claimed is:

1. A wet mop comprising:

a handle having a top first partial region with helical grooves and a lower second partial region located below the first partial region;

a handpiece with a guide element, the handpiece being attached to the handle so that the guide element can cooperate with the helical grooves to cause rotation of the handpiece; and a mop head formed of absorbent strands releasably attached to the handle and to the handpiece, wherein in the lower second partial region, the handpiece is released so that it is able to rotate free of influence by the helical grooves.

2. The wet mop according to claim 1, wherein the handpiece comprises:

an inner sleeve that is equipped with the guide element and an attachment device for a top end of the mop head; and an outer holder mantle that surrounds the sleeve, the outer holder mantle rotatable relative to the sleeve.

3. The wet mop according to claim 1, wherein the handpiece includes a sleeve, and the guide element is at least one ball held captive in a wall of the sleeve so that the guide element can be radially shifted.

4. The wet mop according to claim 1, wherein the handpiece includes a sleeve, and the handle has a spring-assisted stopping element for the sleeve in its top end position.

5. The wet mop according to claim 1, wherein the handpiece includes a sleeve, and a top end position of the sleeve is limited by an end stop.

6. The wet mop according to claim 1, further comprising an attachment device located on the handpiece, a top end of the mop head being attachable to the attachment device, the top end of the mop head being releasable from the attachment device, the attachment device having a greater radius than a connection location for the mop head on an end of the handle.

7. The wet mop according to claim 1, wherein in the lower second partial of region, the mop head is compressible when the handpiece is axially shifted in a direction away from the top first partial region.

8. A wet mop comprising:

a handle having a top first partial region with helical grooves and a lower second partial region located below the first partial region;

a handpiece with a guide element, the handpiece being attached to the handle so that the guide element can cooperate with the helical grooves to cause rotation of the handpiece; and a mop head formed of absorbent strands releasably attached to the handle and to the handpiece, wherein in the lower second partial region, the handpiece is released so that it is able to rotate, wherein the handpiece comprises: an inner sleeve that is equipped with the guide element and an attachment device for a top end of the mop head; and an outer holder mantle that surrounds the sleeve so as to rotate around it, wherein the holder mantle can be axially shifted relative to the sleeve only within certain limits, and that axially shifting the holder mantle locks or releases the guide element.

9. A wet mop comprising:

a handle having a top first partial region with helical grooves and a lower second partial region located below the first partial region;

a handpiece with a guide element, the handpiece being attached to the handle so that the guide element can cooperate with the helical grooves to cause rotation of the handpiece; and a mop head formed of absorbent strands releasably attached to the handle and to the handpiece, wherein in the lower second partial region, the handpiece is released so that it is able to rotate, wherein the helical grooves include a double helix.

10. A wet mop comprising:

a handle having a top first partial region with helical grooves and a lower second partial region located below the first partial region, the first partial region having a larger diameter than the second partial region;

a handpiece with a guide element, the handpiece being attached to the handle so that the guide element can cooperate with the helical grooves to cause rotation of the handpiece; and a mop head formed of absorbent strands-releasably attached to the handle and to the handpiece, wherein in the lower second partial region, the handpiece is released so that it is able to rotate.

11. A wet mop comprising:

a handle having a top first partial region with helical grooves and a lower second partial region located below the first partial region;

a handpiece with a guide element, the handpiece being attached to the handle so that the guide element can cooperate with the helical grooves to cause rotation of the handpiece; and a mop head formed of absorbent strands releasably attached to the handle and to the handpiece, wherein in the lower second partial region, the handpiece is released so that it is able to rotate, wherein a free region is present above the first partial region with the helical grooves, in the form of an annular groove that holds the guide element during a locking process.

12. A wet mop comprising:

a handle having a top first partial region with helical grooves and a lower second partial region located below the first partial region;

a handpiece with a guide-element, the handpiece being attached to the handle so that the guide element can cooperate with the helical grooves to cause rotation of the handpiece; and a mop head formed of absorbent strands releasably attached to the handle and to the handpiece, wherein in the lower second partial region, the handpiece is released so that it is able to rotate, wherein a top end of the helical grooves has funnel-shaped openings.

13. A wet mop comprising:

a handle having a top first partial region with helical grooves and a lower second partial region located below the first partial region;

a handpiece with a guide element, the handpiece being attached to the handle, the guide element being cooperatable with the helical grooves to cause rotation of the handpiece; and a mop head formed of absorbent strands releasably attached to the handle and to the handpiece, wherein in the lower second partial region, the handpiece is configured to be released so that it is rotatable free of influence by the helical grooves.

* * * * *